US010865360B2

(12) United States Patent
Utaka et al.

(10) Patent No.: US 10,865,360 B2
(45) Date of Patent: Dec. 15, 2020

(54) LUBRICATING OIL COMPOSITION FOR ENGINE EQUIPPED WITH SUPERCHARGING MECHANISM, METHOD FOR SUPPRESSING LOW-SPEED PRE-IGNITION IN ENGINE EQUIPPED WITH SUPERCHARGING MECHANISM USING LUBRICATING OIL COMPOSITION, AND METHOD FOR MANUFACTURING LUBRICATING OIL COMPOSITION

(71) Applicant: IDEMITSU KOSAN CO., LTD., Chiyoda-ku (JP)

(72) Inventors: Toshimasa Utaka, Chiba (JP); Kazushi Tamura, Kawasaki (JP); Akira Iijima, Arakawa-ku (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/086,800

(22) PCT Filed: Mar. 24, 2017

(86) PCT No.: PCT/JP2017/012072
§ 371 (c)(1),
(2) Date: Sep. 20, 2018

(87) PCT Pub. No.: WO2017/164384
PCT Pub. Date: Sep. 28, 2017

(65) Prior Publication Data

US 2019/0100713 A1 Apr. 4, 2019

(30) Foreign Application Priority Data

Mar. 24, 2016 (JP) ..... 2016-060557

(51) Int. Cl.

| | |
|---|---|
| ***C10M 169/04*** | (2006.01) |
| ***C10M 125/10*** | (2006.01) |
| ***C10M 135/10*** | (2006.01) |
| ***C10M 129/10*** | (2006.01) |
| ***C10M 159/24*** | (2006.01) |
| ***C10M 159/22*** | (2006.01) |
| *C10N 10/02* | (2006.01) |
| *C10N 10/04* | (2006.01) |
| *C10N 30/04* | (2006.01) |
| *C10N 40/25* | (2006.01) |
| *C10N 70/00* | (2006.01) |

(52) U.S. Cl.
CPC ..... *C10M 169/04* (2013.01); *C10M 125/10* (2013.01); *C10M 129/10* (2013.01); *C10M 135/10* (2013.01); *C10M 159/22* (2013.01); *C10M 159/24* (2013.01); *C10M 2201/062* (2013.01); *C10M 2207/023* (2013.01); *C10M 2219/044* (2013.01); *C10N 2010/02* (2013.01); *C10N 2010/04* (2013.01); *C10N 2030/04* (2013.01); *C10N 2040/25* (2013.01); *C10N 2070/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 2008/0221001 | A1 | 9/2008 | Ritter | |
| 2017/0022441 | A1* | 1/2017 | Onodera | C10M 141/12 |

FOREIGN PATENT DOCUMENTS

| | | | |
|---|---|---|---|
| JP | 2008-523237 | A | 7/2008 |
| JP | 2014-152301 | A | 8/2014 |
| JP | 2015-163673 | A | 9/2015 |
| JP | 2015-209847 | A | 11/2015 |
| WO | WO 2015/114920 | A1 | 8/2015 |

OTHER PUBLICATIONS

International Search Report dated Jun. 27, 2017, in PCT/JP2017/012072 filed Mar. 24, 2017.
Office Action dated Oct. 6, 2020 in Japanese Patent Application No. 2018-507449 (w/ Computer-generated English translation).

* cited by examiner

*Primary Examiner* — Ellen M McAvoy
*Assistant Examiner* — Chantel L Graham
(74) *Attorney, Agent, or Firm* — Oblon, McClelland, Maier & Neustadt, L.L.P.

(57) ABSTRACT

Provided is a lubricating oil composition for engine equipped with a forced-induction mechanism capable of lowering the frequency of occurrence of LSPI, while using a calcium-based detergent. The lubricating oil composition for engine equipped with a forced-induction mechanism contains a base oil (A), a metal-containing surfactant (B) containing at least a calcium-containing surfactant (b1), and at least one basic compound (C) selected from a metal carbonate, a metal hydroxide, and an amine-based compound, wherein the content of sulfur contained in the metal-containing surfactant (B) is 0.2 mass % or more on the basis of the whole amount of the metal-containing surfactant (B); the content of a calcium atom is 0.08 to 0.20 mass % on the basis of the whole amount of the composition; and a mass ratio of the content of the basic compound (C) and the content of a calcium atom derived from the calcium-containing surfactant (b1) [(content of (C))/(calcium content derived from (b1))] is 2.0 or more.

9 Claims, No Drawings

LUBRICATING OIL COMPOSITION FOR ENGINE EQUIPPED WITH SUPERCHARGING MECHANISM, METHOD FOR SUPPRESSING LOW-SPEED PRE-IGNITION IN ENGINE EQUIPPED WITH SUPERCHARGING MECHANISM USING LUBRICATING OIL COMPOSITION, AND METHOD FOR MANUFACTURING LUBRICATING OIL COMPOSITION

TECHNICAL FIELD

The present invention relates to a lubricating oil composition for engine equipped with a forced-induction mechanism, a method for suppressing low-speed pre-ignition in an engine equipped with a forced-induction mechanism by using the lubricating oil composition, and a method for producing the lubricating oil composition.

BACKGROUND ART

In recent years, in order to improve the fuel consumption of gasoline engine vehicles, introduction of an engine equipped with a forced-induction mechanism, such as a turbocharger and a supercharger, is advancing. In addition, by direct injection of a forced-induction mechanism-equipped engine, it is possible to increase a torque at a lower-speed revolution and to decrease a displacement while keeping an equivalent power. For that reason, the fuel consumption can be improved, and a proportion of the mechanical loss can be reduced.

But, in the direction-injection forced-induction mechanism-equipped engine, a phenomenon called low-speed pre-ignition (hereinafter referred to as "LSPI") at the time of low-speed operation is problematic. The LSPI is a phenomenon in which ignition is caused earlier than a set-up ignition timing in a low-speed operation state, and there is a case where an occurrence of LSPI adversely affect an enhancement of fuel consumption and causes an engine failures.

In order to improve the detergency, a metal-based detergent is blended in a lubricating oil composition, and a calcium-based detergent is frequently used as the metal-based detergent. But, in a lubricating oil composition in which a blending amount of the calcium-based detergent is increased in order to enhance the detergency, there is a case where when the lubricating oil invades into an engine cylinder, the LSPI is induced.

As means for reducing the frequency of occurrence of LSPI, there are proposed the technologies of PTLs 1 and 2.

PTL 1 proposes a lubricating oil composition in which the amount of a calcium-based detergent to be blended in the lubricating oil composition is decreased, and a compound containing magnesium, molybdenum, or the like is combined in a specified ratio, thereby reducing the frequency of occurrence of LSPI.

PTL 2 proposes a lubricating oil composition in which the amount of a calcium-based detergent to be blended in the lubricating oil composition is decreased, and a magnesium-based detergent is blended, thereby reducing the frequency of occurrence of LSPI.

CITATION LIST

Patent Literature

PTL 1: JP 2015-163673 A
PTL 2: JP 2015-209847 A

SUMMARY OF INVENTION

Technical Problem

In all of PTLs 1 and 2, the calcium-based detergent is considered to be a cause of occurrence of LSPI, and the frequency of occurrence of LSPI is lowered by reducing the content of the calcium-based detergent or blending other metal-based detergent, such as a magnesium-based detergent, in place of the calcium-based detergent.

But, PTLs 1 and 2 do not investigate any means for lowering the frequency of occurrence of LSPI while using the calcium-based detergent in a positive manner. In view of the matter that the calcium-based detergent has such an advantage that it is more excellent in a cleaning action than a magnesium-based detergent and a sodium-based detergent, it is desired to lower the frequency of occurrence of LSPI while using the calcium-based detergent in a positive manner.

In addition, there is a case that the magnesium-based detergent forms an acicular crystal in the lubricating oil composition depending upon a composition or use conditions of the lubricating oil composition, resulting in gelation.

Furthermore, in recent years, even in a gas engine, it is also contemplated to achieve high efficiency by mounting it with a supercharger. Even in the gas engine, it has been noted that the calcium-based detergent participates in self-ignition of a fuel, thereby affecting the abnormal combustion.

Now, an object of the present invention is to provide a lubricating oil composition for engine equipped with a forced-induction mechanism capable of lowering the frequency of occurrence of abnormal combustion, such as LSPI, while using a calcium-based detergent. In addition, another object of the present invention is to provide a method for suppressing low-speed pre-ignition in an engine equipped with a forced-induction mechanism by using the lubricating oil composition, and a method for producing the lubricating oil composition.

Solution to Problem

The present invention provides a lubricating oil composition for engine equipped with a forced-induction mechanism, a method for suppressing low-speed pre-ignition in an engine equipped with a forced-induction mechanism by using the lubricating oil composition, and a method for producing the lubricating oil composition, as mentioned below.

[1] A lubricating oil composition for engine equipped with a forced-induction mechanism, containing a base oil (A), a metal-containing surfactant (B) containing at least a calcium-containing surfactant (b1), and at least one basic compound (C) selected from the group consisting of a metal carbonate, a metal hydroxide, and an amine-based compound, wherein the content of sulfur contained in the metal-containing surfactant (B) is 0.2 mass % or more on the basis of the whole amount of the metal-containing surfactant (B); the content of a calcium atom is 0.08 to 0.20 mass % on the basis of the whole amount of the composition; and a mass ratio of the content of the basic compound (C) and the content of a calcium atom derived from the calcium-containing surfactant (b1) [(content of (C))/(calcium content derived from (b1))] is 2.0 or more.

[2] A method for suppressing low-speed pre-ignition in an engine equipped with a forced-induction mechanism, including adding the lubricating oil composition for engine equipped with a forced-induction mechanism as set forth in the above [1] to an engine equipped with a forced-induction mechanism.

[3] A method for producing a lubricating oil composition for engine equipped with a forced-induction mechanism, including a mixing step of mixing a base oil (A), a metal-containing surfactant (B) containing at least a calcium-containing surfactant (b1), and at least one basic compound (C) selected from the group consisting of a metal carbonate, a metal hydrogencarbonate, a metal hydroxide, and an amine-based compound, wherein the mixing step is performed so as to satisfy the following mixing conditions (1) to (3):

<Mixing Conditions>

(1) The sulfur content contained in the metal-containing surfactant (B) is 0.2 mass % or more on the basis of the whole amount of the metal-containing surfactant (B);

(2) The content of a calcium atom is 0.08 to 0.20 mass % on the basis of the whole amount of the composition; and (3) A mass ratio of the content of the basic compound (C) and the content of a calcium atom derived from the calcium-containing surfactant (b1) [(content of (C))/(calcium content derived from (b1))] is 2.0 or more.

Advantageous Effects of Invention

In accordance with the lubricating oil composition for engine equipped with a forced-induction mechanism of the present invention, the frequency of occurrence of abnormal combustion, such as LSPI, can be lowered while using a calcium-based detergent.

DESCRIPTION OF EMBODIMENTS

Embodiments of the present invention are hereunder described.

[Lubricating Oil Composition for Engine Equipped with a Forced-Induction Mechanism]

The lubricating oil composition for engine equipped with a forced-induction mechanism of the present embodiment is one containing a base oil (A), a metal-containing surfactant (B) containing at least a calcium-containing surfactant (b1), and at least one basic compound (C) selected from a metal carbonate, a metal hydroxide, and an amine-based compound, wherein the content of sulfur contained in the metal-containing surfactant (B) is 0.2 mass % or more on the basis of the whole amount of the metal-containing surfactant (B); the content of a calcium atom is 0.08 to 0.20 mass % on the basis of the whole amount of the composition; and a mass ratio of the content of the basic compound (C) and the content of a calcium atom derived from the calcium-containing surfactant (b1) [(content of (C))/(calcium content derived from (b1))] is 2.0 or more.

The lubricating oil composition for engine equipped with a forced-induction mechanism is hereinafter also referred to simply as "lubricating oil composition".

<Base Oil (A)>

Examples of the base oil (A) include a mineral oil and/or a synthetic oil.

Examples of the mineral oil include a paraffin-based mineral oil, an intermediate-based mineral oil, and a naphthene-based mineral oil, which are obtained by an ordinary refining method, such as solvent refining and hydrogenation refining; and a wax isomerized oil, which is produced through isomerization of a wax, such as a wax produced by the Fischer-Tropsch process or the like (gas-to-liquid wax), and mineral oil-based wax.

Examples of the synthetic oil include a hydrocarbon-based synthetic oil and an ether-based synthetic oil. Examples of the hydrocarbon-based synthetic oil may include an alkylbenzene and an alkylnaphthalene. Examples of the ether-based synthetic oil include a polyoxyalkylene glycol and a polyphenyl ether.

Among those, from the viewpoint of improving the detergency, the LSPI preventing performance, and the abnormal combustion preventing performance of the lubricating oil composition, at least one selected from a mineral oil and a synthetic oil which are classified into Groups 3 to 5 of the base oil categories of the API (American Petroleum Institute) is preferred.

Although the base oil (A) may be a single component system using one of the aforementioned mineral oils and synthetic oils, it may also be a mixed system obtained by mixing two or more of the mineral oils, mixing two or more of the synthetic oils, or mixing one or more each of the mineral oils and the synthetic oils.

From the viewpoint of a balance between fuel saving properties and an evaporation loss, a kinematic viscosity at 100° C. of the base oil (A) is preferably 2 to 20 $mm^2/s$, more preferably 2 to 15 $mm^2/s$, and still more preferably 3 to 10 $mm^2/s$.

In the case where the base oil (A) is a base oil composed of a mixture of two or more base oils, it is preferred that the kinematic viscosity of the mixed base oil satisfies the aforementioned range.

In the present embodiment, the kinematic viscosity of the base oil (A) or the like can be measured in conformity with JIS K2283:2000.

A content proportion of the base oil (A) is preferably 70 to 90 mass %, more preferably 70 to 88 mass %, and still more preferably 75 to 86 mass % on the basis of the whole amount of the lubricating oil composition.

<Metal-Containing Surfactant (B)>

The lubricating oil composition of the present embodiment contains a metal-containing surfactant (B). The metal-containing surfactant (B) makes the detergency good due to a synergistic action with a basic compound (C), and in its turn, it has a role of lowering the frequency of occurrence of abnormal combustion, such as LSPI.

In the present embodiment, at least a calcium-containing surfactant (b1) is contained as the metal-containing surfactant (B).

In the present embodiment, the content of sulfur contained in the metal-containing surfactant (B) is 0.2 mass % or more on the basis of the whole amount of the metal-containing surfactant (B).

The calcium-containing surfactant (b1) has an excellent cleaning action, whereas it is liable to generate abnormal combustion, such as LSPI. In the case where the sulfur content contained in the metal-containing surfactant (B) is less than 0.2 mass % on the basis of the whole amount of the metal-containing surfactant (B), the frequency of occurrence of abnormal combustion, such as LSPI, which is caused due to the calcium-containing surfactant (b1), cannot be lowered. On the other hand, in the present embodiment, by controlling the sulfur content contained in the metal-containing surfactant (B) to 0.2 mass % or more on the basis of the whole amount of the metal-containing surfactant (B), the frequency of occurrence of abnormal combustion, such as LSPI, can be lowered.

From the viewpoint of lowering the frequency of occurrence of abnormal combustion, such as LSPI, the sulfur content contained in the metal-containing surfactant (B) is preferably 0.3 mass % or more, more preferably 0.5 mass % or more, still more preferably 5.0 mass % or more, and yet still more preferably 8.0 mass % or more on the basis of the whole amount of the metal-containing surfactant (B). In addition, from the viewpoint of keeping an acid-neutralizing action due to a balance between the metal-containing surfactant (B) and the basic compound (C) to prevent corrosion of engine members from occurring, the sulfur content contained in the metal-containing surfactant (B) is preferably 20.0 mass % or less, more preferably 15.0 mass % or less, and still more preferably 12.0 mass % or less on the basis of the whole amount of the metal-containing surfactant (B).

With respect to the sulfur content contained in the metal-containing surfactant (B), while a large number of lower limit values and upper limit values have been expressed, in the present embodiment, the sulfur content contained in the metal-containing surfactant (B) can be regulated by appropriately combining each of the lower limit values and each of the upper limit values.

In addition, the sulfur content can be regulated by using, as the metal-containing surfactant (B), a metal-containing surfactant containing sulfur in a structure thereof. The sulfur content contained in the metal-containing surfactant (B) can be regulated by using the calcium-containing surfactant (b1) containing sulfur in a structure thereof, such as calcium sulfonate, and regulating the content of the calcium sulfonate in the metal-containing surfactant (B).

In the present embodiment, the sulfur content as well as the calcium content, the magnesium content, the sodium content, the molybdenum content, the phosphorus content, and the zinc content as mentioned later can be measured in conformity with JIS-5S-38-92.

From the viewpoint of lowering the frequency of occurrence of abnormal combustion, such as LSPI, the sulfur content contained in the calcium-containing surfactant (b1) is preferably 0.3 mass % or more, more preferably 0.5 mass % or more, still more preferably 5.0 mass % or more, and yet still more preferably 8.0 mass % or more on the basis of the whole amount of the calcium-containing surfactant (b1). Although an upper limit of the sulfur content contained in the calcium-containing surfactant (b1) is not particularly limited, it is 10.0 mass % or less.

As the calcium-containing surfactant (b1), one or more selected from calcium sulfonate, calcium phenate, and calcium salicylate can be used. Among those, calcium phenate and/or calcium sulfonate, which is easy to lower the frequency of occurrence of abnormal combustion, such as LSPI, is preferred, and calcium phenate is more preferred.

As the calcium sulfonate, one having a molecular weight of 300 to 1,500 is preferred, and one having a molecular weight of 400 to 700 is more preferred. As the calcium sulfonate, a calcium salt of an alkyl aromatic sulfonic acid, such as a calcium alkylbenzene sulfonate obtained by sulfonating an alkyl aromatic compound, is preferably used.

As the calcium phenate, one having a molecular weight of 300 to 1,500 is preferred, and one having a molecular weight of 400 to 700 is more preferred. As the calcium phenate, a calcium salt of an alkylphenol (calcium alkylphenate), a calcium salt of an alkylphenol sulfide, and a calcium salt of a Mannich reaction product of an alkylphenol are preferably used.

As the calcium salicylate, one having a molecular weight of 300 to 1,500 is preferred, and one having a molecular weight of 400 to 700 is more preferred. As the calcium salicylate, a calcium alkylsalicylate is preferably used.

The alkyl group constituting the calcium-containing surfactant (b1) is preferably an alkyl group having a carbon number of 4 to 30, and more preferably an alkyl group having a carbon number of 6 to 24, and these alkyl groups may be either straight-chained or branched. These may be a primary alkyl group, a secondary alkyl group, or a tertiary alkyl group.

Examples of the calcium sulfonate, the calcium phenate, and the calcium salicylate include neutral calcium-containing surfactants, such as a neutral calcium sulfonate, a neutral calcium phenate, and a neutral calcium salicylate, which are obtained by allowing the aforementioned alkyl aromatic sulfonic acid, alkylphenol, alkylphenol sulfide, Mannich reaction product of an alkylphenol, or alkylsalicylic acid to react directly with a calcium base, such as an oxide or hydroxide of calcium, or once converting into an alkali metal salt, such as a sodium salt and a potassium salt, and then substituting with a calcium salt.

Furthermore, examples of the calcium sulfonate, the calcium phenate, and the calcium salicylate include basic calcium-containing surfactants, such as a basic calcium sulfonate, a basic calcium phenate, and a basic calcium salicylate, which are obtained by heating the aforementioned neutral calcium-containing surfactant and an excess of a calcium salt or a calcium base in the presence of water; and overbased calcium-containing surfactants, such as an overbased calcium sulfonate, an overbased calcium phenate, and an overbased calcium salicylate, which are obtained by allowing the aforementioned neutral calcium-containing surfactant to react with a carbonate or borate of calcium in the presence of a carbonic acid gas.

The content of the calcium-containing surfactant (b1) is preferably 50 mass % or more, more preferably 80 mass % or more, still more preferably 85 mass % or more, and yet still more preferably 90 mass % or more on the basis of the whole amount of the metal-containing surfactant (B). When the calcium-containing surfactant (b1) is contained in the aforementioned proportion, the detergency can be made good.

In the case where other metal-containing surfactant than the calcium-containing surfactant (b1) is contained as the metal-containing surfactant (B), the content of the calcium-containing surfactant (b1) is preferably 50 mass % or more and 99 mass % or less, more preferably 80 mass % or more and 98 mass % or less, and still more preferably 90 mass % or more and 97 mass % or less on the basis of the whole amount of the metal-containing surfactant (B).

Although the content of the metal-containing surfactant (B) cannot be unequivocally defined, it is preferably 0.1 to 6.0 mass %, more preferably 0.2 to 5.0 mass %, and still more preferably 0.3 to 4.0 mass % on the basis of the whole amount of the lubricating oil composition.

In the present embodiment, other metal-containing surfactant than the calcium-containing surfactant (b1) may be contained as the metal-containing surfactant (B).

Examples of the metal-containing surfactant other than the calcium-containing surfactant (b1) include one or more selected from a magnesium-containing surfactant (b2) and a sodium-containing surfactant (b3). The magnesium-containing surfactant (b2) and the sodium-containing surfactant (b3) are excellent from the standpoint that the frequency of occurrence of abnormal combustion, such as LSPI, hardly rises. There is a case where the magnesium-containing surfactant (b2) forms an acicular crystal in the lubricating oil composition depending upon a composition or use conditions of the lubricating oil composition, resulting in gelation. In addition, there is a case where when the moisture is incorporated into the lubricating oil composition, the sodium-containing surfactant (b3) reacts with water to produce a precipitate.

Examples of the magnesium-containing surfactant (b2) include a magnesium sulfonate, a magnesium phenate, and a magnesium salicylate.

Examples of the sodium-containing surfactant (b3) include a sodium sulfonate, a sodium phenate, and a sodium salicylate.

With respect to the magnesium-containing surfactant (b2) and the sodium-containing surfactant (b3), the sulfonate, the phenate, and the salicylate are the same as those described for the aforementioned sulfonate, phenate, and salicylate in the calcium-containing surfactant (b1). In addition, the matter that not only the neutral form but also the basic and overbased forms may be adopted is also the same as described for the aforementioned calcium-containing surfactant (b1).

As for the metal-containing surfactant (B) which is used in the present embodiment, from the viewpoint of making it easy to control the content of sulfur contained in the metal-containing surfactant (B) to 0.2 mass % or more on the basis of the whole amount of the metal-containing surfactant (B), the calcium sulfonate and the magnesium sulfonate are preferably compounds represented by the following general formula (1-1) (e.g., a calcium alkylbenzenesulfonate and a magnesium alkylbenzenesulfonate); and the sodium sulfonate is preferably a compound represented by the following general formula (1-2) (e.g., a sodium alkylbenzenesulfonate). Similarly, the calcium phenate and the magnesium phenate are preferably compounds represented by the following general formula (2-1) (e.g., a calcium alkylphenate and a magnesium alkylphenate); and the sodium phenate is preferably a compound represented by the following general formula (2-2) (e.g., a sodium alkylphenate). In addition, similarly, the calcium salicylate and the magnesium salicylate are preferably compounds represented by the following general formula (3-1) (e.g., a calcium alkylsalicylate and a magnesium alkylsalicylate); and the sodium salicylate is preferably a compound represented by the following general formula (3-2) (e.g., a sodium alkylsalicylate).

(1-1)

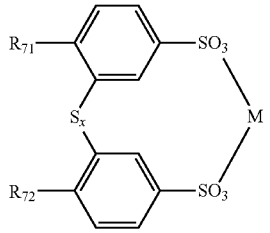

(1-2)

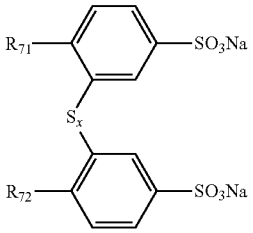

In the formula (1-1), M represents a calcium atom or a magnesium atom. In addition, in the formula (1-1) and the formula (1-2), x represents an integer of 1 to 2. In addition, in the formula (1-1) and the formula (1-2), $R_{71}$ and $R_{72}$ each represent an alkyl group having a carbon number of 4 to 30, and may be the same as or different from each other. The carbon number of the alkyl group of $R_{71}$ and $R_{72}$ is preferably 6 to 24, and more preferably 10 to 24.

(2-1)

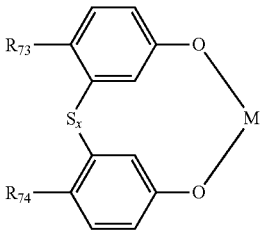

(2-2)

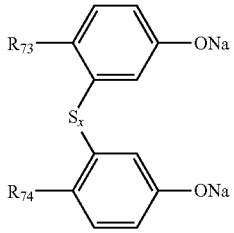

In the formula (2-1), M represents a calcium atom or a magnesium atom. In addition, in the formula (2-1) and the formula (2-2), x represents an integer of 1 to 2. In addition, in the formula (2-1) and the formula (2-2), $R_{73}$ and $R_{74}$ each represent an alkyl group having a carbon number of 4 to 30, and may be the same as or different from each other. The carbon number of the alkyl group of $R_{73}$ and $R_{74}$ is preferably 6 to 24, and more preferably 10 to 24.

(3-1)

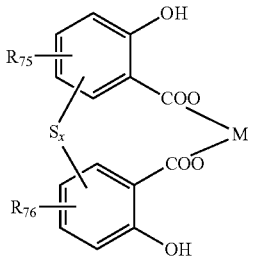

(3-2)

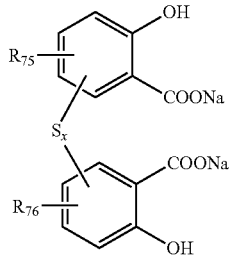

In the formula (3-1), M represents a calcium atom or a magnesium atom. In addition, in the formula (3-1) and the formula (3-2), x represents an integer of 1 to 2. In addition, in the formula (3-1) and the formula (3-2), $R_{75}$ and $R_{76}$ each represent an alkyl group having a carbon number of 4 to 30, and may be the same as or different from each other. The carbon number of the alkyl group of $R_{75}$ and $R_{76}$ is preferably 6 to 24, and more preferably 10 to 24.

<Basic Compound (C)>

The lubricating oil composition of the present embodiment contains at least one basic compound (C) selected from a metal carbonate, a metal hydrogencarbonate, a metal hydroxide, and an amine-based compound. Among those, from the viewpoint of making it easy to lower the frequency of occurrence of abnormal combustion, such as LSPI, a metal carbonate, metal hydroxide, and a metal atom-free dithiocarbamate that is one kind of the amine-based compound are preferred. In addition, the amine-based compound is suitable from the standpoint that it may also act as an anti-corrosive and a rust inhibitor.

The basic compound (C) has a role of lowering the frequency of occurrence of abnormal combustion, such as LSPI, which is caused due to the calcium-containing surfactant (b1).

In the present embodiment, a mass ratio of the content of the basic compound (C) and the content of a calcium atom derived from the calcium-containing surfactant (b1) [(content of (C))/(calcium content derived from (b1))] is required to be 2.0 or more.

In the case where the foregoing mass ratio is less than 2.0, the content of the basic compound (C) becomes relatively small, so that the frequency of occurrence of abnormal combustion, such as LSPI, which is caused due to the calcium-containing surfactant (b1), cannot be thoroughly lowered.

The aforementioned ratio is preferably 2.5 or more, more preferably 3.0 or more, and still more preferably 5.0 or more.

By not excessively increasing the content of the basic compound (C), it is possible to make it hard to cause clogging of an engine oil filter. For this reason, the aforementioned ratio is preferably 60.0 or less, more preferably 40.0 or less, and still more preferably 30.0 or less.

In the present embodiment, a mass ratio of the content of the metal-containing surfactant (B) and the content of the basic compound (C) [(content of (B))/(content of (C))] is preferably 15.0 or less. By controlling the foregoing mass ratio to 15.0 or less, the amount of the basic compound (C) used is secured, and it becomes easy to thoroughly lower the frequency of occurrence of abnormal combustion, such as LSPI, which is caused due to the metal-containing surfactant (B).

The aforementioned ratio is more preferably 10.0 or less, still more preferably 8.0 or less, and yet still more preferably 6.0 or less.

From the viewpoint of controlling the content of the metal-containing surfactant (B) relative to the content of the basic compound (C) to a fixed amount or more, to make the detergency good, the aforementioned ratio is preferably 0.2 or more, more preferably 0.3 or more, and still more preferably 1.0 or more.

With respect to the aforementioned ratio, while a large number of lower limit values and upper limit values have been expressed, in the present embodiment, the ratio can be regulated by appropriately combining each of the lower limit values and each of the upper limit values.

Although the content of the basic compound (C) varies with the content of the metal-containing surfactant (B), and hence, it cannot be unequivocally defined, it is preferably 0.10 to 1.00 mass %, more preferably 0.20 to 0.80 mass %, and still more preferably 0.30 to 0.70 mass % on the basis of the whole amount of the lubricating oil composition.

Examples of the metal carbonate that is one example of the basic compound (C) include lithium carbonate, sodium carbonate, potassium carbonate, magnesium carbonate, calcium carbonate, and barium carbonate. Among those, from the viewpoint of making it easy to lower the frequency of occurrence of abnormal combustion, such as LSPI, sodium carbonate, magnesium carbonate, and calcium carbonate are preferred.

Examples of the metal hydrogencarbonate that is one example of the basic compound (C) include sodium hydrogencarbonate and potassium hydrogencarbonate.

Examples of the metal hydroxide that is one example of the basic compound (C) include lithium hydroxide, sodium hydroxide, potassium hydroxide, magnesium hydroxide, calcium hydroxide, and barium hydroxide.

Examples of the amine-based compound that is one example of the basic compound (C) include ammonia, an aliphatic amine-based compound, and a metal-free dithiocarbamate.

Examples of the aliphatic amine-based compound that is one example of the aforementioned amine-based compound include an amine compound (c1) having one or more hydroxy groups and one or more amino groups; an amine compound (c2) having two or more amino groups; and an amine compound (c3) having only one amino group.

In more detail, among those, examples of the amine compound (c1) include compounds represented by the following general formulae (C1) and (C2); examples of the amine compound (c1) or the amine compound (c2) include a compound represented by the general formula (C3) or (C4). In addition, examples of the amine compound (c3) include a compound represented by the general formula (C5).

(C1)

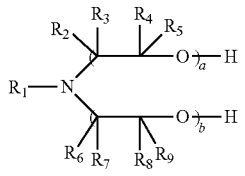

(C2)

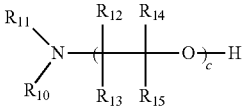

(C3)

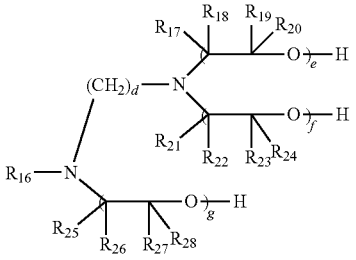

-continued (C4)

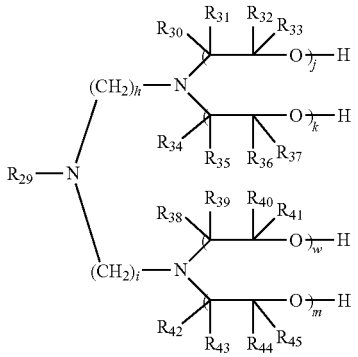

(C5)

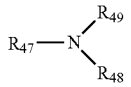

In the formulae (C1) to (C5), $R_1$, $R_{10}$, $R_{11}$, $R_{16}$, $R_{29}$, and $R_{47}$ are each a hydrocarbon group having a carbon number of 1 to 32, and $R_{10}$ and $R_{11}$ may be the same as or different from each other. Such a hydrocarbon group may be either saturated or unsaturated, may be either aliphatic or aromatic, and may be straight-chained, branched, or cyclic. For example, examples thereof include an aliphatic hydrocarbon group, such as an alkyl group and an alkenyl group, and an aromatic hydrocarbon group.

Specifically, the examples of the aforementioned hydrocarbon group include aliphatic hydrocarbon groups, such as a methyl group, an ethyl group, a propyl group, a butyl group, a butenyl group, a hexyl group, a hexenyl group, an octyl group, an octenyl group, a 2-ethylhexyl group, a nonyl group, a decyl group, an undecyl group, a decenyl group, a dodecyl group, a dodecenyl group, a tridecyl group, a tetradecyl group, a tetradecenyl group, a pentadecyl group, a hexadecyl group, a hexadecenyl group, a heptadecyl group, an octadecyl group, an octadecenyl group, a stearyl group, an isostearyl group, an oleyl group, a linol group, a nonadecyl group, an icosyl group, an eicosyl group, a henicosyl group, a docosyl group, a tricosyl group, a tetracosyl group, a pentacosyl group, hexacosyl group, a heptacosyl group, an octacosyl group, a nonacosyl group, a triacontyl group, a hentriacontyl group, a dotriacontyl group, a decene trimer group, a polybutene group, a cyclopentyl group, a cyclohexyl group, a methylcyclohexyl group, an ethylcyclohexyl group, a propylcyclohexyl group, a dimethylcyclohexyl group, and a trimethylcyclohexyl group; and aromatic hydrocarbon groups, such as a phenyl group, a methylphenyl group, an ethylphenyl group, a dimethylphenyl group, a propylphenyl group, a trimethylphenyl group, a butylphenyl group, and a naphthyl group.

The aforementioned hydrocarbon group is preferably a hydrocarbon group having a carbon number of 4 to 22, and more preferably a hydrocarbon group having a carbon number of 6 to 18.

$R_2$ to $R_9$, $R_{12}$ to $R_{15}$, $R_{17}$ to $R_{28}$, $R_{30}$ to $R_{45}$, and $R_{48}$ to $R_{49}$ are each a hydrogen atom, a hydrocarbon group having a carbon number of 1 to 18, or an oxygen-containing hydrocarbon group containing an ether bond or an ester bond, and may be the same as or different from each other, with a hydrogen atom or a hydrocarbon group being preferred.

The foregoing hydrocarbon group may be either saturated or unsaturated, may be either aliphatic or aromatic, and may be straight-chained, branched, or cyclic. For example, examples thereof include an aliphatic hydrocarbon group, such as an alkyl group and an alkenyl group, and an aromatic hydrocarbon group. More specifically, examples thereof include aliphatic hydrocarbon groups, such as a methyl group, an ethyl group, a propyl group, a butyl group, a butenyl group, a hexyl group, a hexenyl group, an octyl group, an octenyl group, a 2-ethylhexyl group, a nonyl group, a decyl group, an undecyl group, a decenyl group, a dodecyl group, a dodecenyl group, a tridecyl group, a tetradecyl group, a tetradecenyl group, a pentadecyl group, a hexadecyl group, a hexadecenyl group, a heptadecyl group, an octadecyl group, an octadecenyl group, a stearyl group, an isostearyl group, an oleyl group, a linol group, a cyclopentyl group, a cyclohexyl group, a methylcyclohexyl group, an ethylcyclohexyl group, a propylcyclohexyl group, a dimethylcyclohexyl group, and a trimethylcyclohexyl group; and aromatic hydrocarbon groups, such as a phenyl group, a methylphenyl group, an ethylphenyl group, a dimethylphenyl group, a propylphenyl group, a trimethylphenyl group, a butylphenyl group, and a naphthyl group.

This hydrocarbon group is preferably one having a carbon number of 1 to 18, more preferably one having a carbon number of 1 to 16, and especially preferably one having a carbon number of 1 to 12.

The oxygen-containing hydrocarbon group containing an ether bond or an ester bond is, for example, one having a carbon number of 1 to 18. Examples thereof may include a methoxymethyl group, an ethoxymethyl group, a propoxymethyl group, an isopropoxymethyl group, a n-butoxymethyl group, a t-butoxymethyl group, a hexyloxymethyl group, an octyloxymethyl group, a 2-ethylhexyloxymethyl group, a decyloxymethyl group, a dodecyloxymethyl group, a 2-butyloctyloxymethyl group, a tetradecyloxymethyl group, a hexadecyloxymethyl group, a 2-hexyldodecyloxymethyl group, an allyloxymethyl group, a phenoxy group, a benzyloxy group, a methoxyethyl group, a methoxypropyl group, a 1,1-bismethoxypropyl group, a 1,2-bismethoxypropyl group, an ethoxypropyl group, a (2-methoxyethoxy) propyl group, a (1-methyl-2-methoxy)propyl group, an acetyloxymethyl group, a propanoyloxymethyl group, a butanoyloxymethyl group, a hexanoyloxymethyl group, an octanoyloxymethyl group, a 2-ethylhexanoyloxymethyl group, a decanoyloxymethyl group, a dodecanoyloxymethyl group, a 2-butyloctanoyloxymethyl group, a tetradecanoyloxymethyl group, a hexadecanoyloxymethyl group, a 2-hexyldodecanoyloxymethyl group, and a benzoyloxymethyl group.

a, b, c, e, f, g, j, k, w, and m each represent an integer of 0 to 20; d, h, and i each represent an integer of 1 to 6; (a+b) is 1 to 20; (e+f+g) is 0 to 20; and (j+k+w+m) is 0 to 20.

(a+b) is preferably 1 to 12, and more preferably 1 to 10. In addition, c, (e+f+g), and (j+k+w+m) are each preferably 0 to 12, and more preferably 0 to 7. d, h, and i are each preferably 2 to 4.

In the general formula (C1), it is preferred that $R_2$ to $R_5$ and $R_6$ to $R_9$ are all a hydrogen atom, or not only $R_2$ to $R_4$ and $R_6$ to $R_8$ are all a hydrogen atom, but also either one or both of $R_5$ and $R_9$ are a hydrocarbon group.

In the general formula (C2), it is preferred that not only $R_{12}$ to $R_{14}$ are all a hydrogen atom, but also $R_{15}$ is a hydrogen atom or a hydrocarbon group.

In the general formula (C3), it is preferred that e, f, and g are each 1 or more, and $R_{17}$ to $R_{28}$ are all a hydrogen atom, and it is more preferred that e, f, and g are all 1. As a matter of course, in the general formula (C3), e, f, and g may be all 0, so that no hydroxy group is existent.

In the general formula (C4), it is preferred that j, k, w, and m are all 0. Furthermore, in the general formula (C5), $R_{47}$ is preferably an alkyl group, and at least one of $R_{48}$ and $R_{49}$ may be a hydrocarbon group, and the hydrocarbon group is preferably an alkyl group.

Examples of the metal atom-free dithiocarbamate that is one example of the amine-based compound include one represented by the following general formula (C6).

(C6)

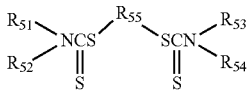

In the formula (C6), $R_{51}$ to $R_{54}$ each represent an alkyl group having a carbon number of 1 to 10 or a phenyl group, and $R_{51}$ to $R_{54}$ may be the same as or different from each other. $R_{55}$ represents an alkylene group having a carbon number of 1 to 3.

In the formula (C6), $R_{51}$ to $R_{54}$ are each preferably an alkyl group having a carbon number of 2 to 8 or a phenyl group, and more preferably an alkyl group having a carbon number of 3 to 5. In addition, $R_{51}$ to $R_{54}$ are preferably the same as each other.

In the formula (C6), $R_{55}$ is preferably an alkylene group having a carbon number of 1 to 2, and more preferably an alkylene group having a carbon number of 1 (methylene group).

Specific examples of the metal atom-free dithiocarbamate of the general formula (C6) include bis(diethylthiocarbamate)methylene, bis(diethyldithiocarbamate)ethylene, bis(dipropylthiocarbamate)methylene, bis(dipropyldithiocarbamate)ethylene, bis(dibutyldithiocarbamate)methylene, bis(dibutyldithiocarbamate)ethylene, bis(dipentyldithiocarbamate)methylene, bis(dipentyldithiocarbamate)ethylene, bis(dihexyldithiocarbamate)methylene, and bis(dihexyldithiocarbamate)ethylene. Among those, bis(dibutyldithiocarbamate)methylene is most preferred.

As the basic compound (C), it is preferred to jointly use the metal atom-free dithiocarbamate and the metal carbonate. A mass ratio of the content of the metal atom-free dithiocarbamate and the content of the metal carbonate [(content of metal atom-free dithiocarbamate)/(content of metal carbonate)] is preferably 1.0 or more, more preferably 1.2 or more and 5.0 or less, and still more preferably 2.0 or more and 4.0 or less.

<Additive>

The lubricating oil composition of the present embodiment may further contain one or more general-purpose additives selected from a viscosity index improver, a detergent dispersant, a pour-point depressant, an anti-wear agent, an antioxidant, and so on.

The content of each of these additives can be appropriately regulated, and it is typically 0.001 to 10 mass %, and preferably 0.005 to 5 mass % on the basis of the whole amount of the composition. A total content of these additives is preferably 20 mass % or less, more preferably 10 mass % or less, still more preferably 5 mass % or less, and yet still more preferably 2 mass % or less on the basis of the whole amount of the composition.

<Properties of Lubricating Oil Composition>

In the lubricating oil composition of the present embodiment, the content of a calcium atom is required to be 0.08 to 0.20 mass % on the basis of the whole amount of the composition.

In the case where the content of a calcium atom is less than 0.08 mass % on the basis of the whole amount of the composition, the detergency cannot be made good. On the other hand, in the case where the content of a calcium atom is more than 0.20 mass % on the basis of the whole amount of the composition, even when a predetermined amount of the basic compound (C) is contained, the frequency of occurrence of abnormal combustion, such as LSPI, cannot be lowered.

The content of a calcium atom is preferably 0.10 mass % or more, more preferably 0.12 mass % or more, and still more preferably 0.13 mass % or more on the basis of the whole amount of the composition. In addition, the content of a calcium atom is preferably 0.19 mass % or less, more preferably 0.18 mass % or more, and still more preferably 0.17 mass % or less on the basis of the whole amount of the composition.

With respect to the content of a calcium atom, while a large number of lower limit values and upper limit values have been expressed, in the present embodiment, the content of a calcium atom can be regulated by appropriately combining each of the lower limit values and each of the upper limit values.

In the lubricating oil composition of the present embodiment, a mass ratio of the content of a calcium atom derived from the calcium-containing surfactant (b1) and the content of a calcium atom contained in the whole amount of the composition [(calcium content derived from (b1))/(calcium content of the whole amount of the composition)] is preferably 0.05 to 0.80, more preferably 0.07 to 0.75, and sill more preferably 0.20 to 0.65.

By controlling the foregoing ratio to 0.05 or more, the detergency of the lubricating oil composition can be enhanced, and by controlling the foregoing ratio to 0.80 or less, the frequency of occurrence of abnormal combustion, such as LSPI, can be easily lowered.

In the lubricating oil composition of the present embodiment, the magnesium content is preferably 0.10 mass % or less, more preferably 0.08 mass % or less, and still more preferably 0.06 mass % or less on the basis of the whole amount of the composition.

In the lubricating oil composition of the present embodiment, the sodium content is preferably 0.10 mass % or less, more preferably 0.08 mass % or less, and still more preferably 0.06 mass % or less on the basis of the whole amount of the composition.

In the lubricating oil composition of the present embodiment, the sulfur content is preferably 0.01 to 0.80 mass %, more preferably 0.10 to 0.50 mass %, and still more preferably 0.20 to 0.40 mass % on the basis of the whole amount of the composition.

By controlling the foregoing proportion to 0.01 mass % or more, the frequency of occurrence of abnormal combustion, such as LSPI, can be easily lowered, and by controlling the foregoing proportion to 0.80 mass % or less, the corrosion of engine members or the like can be prevented from occurring.

In the lubricating oil composition of the present embodiment, the molybdenum content is preferably 0.01 to 0.15 mass %, more preferably 0.012 to 0.1 mass %, still more preferably 0.015 to 0.08 mass %, yet still more preferably 0.02 to 0.08 mass %, and especially preferably more than 0.04 mass % and 0.07 mass % or less on the basis of the whole amount of the composition.

In the lubricating oil composition of the present embodiment, the phosphorus content is preferably 0.01 to 0.20 mass %, more preferably 0.03 to 0.15 mass %, still more preferably 0.05 to 0.10 mass %.

In the lubricating oil composition of the present invention, the zinc content is preferably 0.06 to 0.11 mass % on the basis of the whole amount of the composition.

In the present embodiment, from the viewpoint of a balance between fuel saving properties and an evaporation loss, a kinematic viscosity at 100° C. of the lubricating oil composition is preferably 4.0 to 9.2 $mm^2/s$, more preferably 5.0 to 9.2 $mm^2/s$, and still more preferably 6.1 to 9.2 $mm^2/s$.

In the present embodiment, a kinematic viscosity at 40° C. of the lubricating oil composition is preferably 20.0 to 45.0 $mm^2/s$, more preferably 22.0 to 40.0 $mm^2/s$, and still more preferably 25.0 to 35.0 $mm^2/s$.

In the present embodiment, a viscosity index of the lubricating oil composition is preferably 145 or more, more preferably 150 or more, and still more preferably 155 or more.

In the present embodiment, an HTHS viscosity at 150° C. of the lubricating oil composition is preferably 1.4 to 2.9 mPa·s, more preferably 1.4 to 2.6 mPa·s, and more preferably 2.0 to 2.6 mPa·s.

When the HTHS viscosity at 150° C. is 1.4 mPa·s or more, the lubricating performance can be made good, and when it is 2.9 mPa·s or less, not only the excellent viscosity characteristics at low temperatures are obtained, but also excellent fuel saving properties are obtained. The HTHS viscosity at 150° C. can also be assumed as a viscosity in a high-temperature region at the time of high-speed operation of an engine. So long as the HTHS viscosity at 150° C. falls within the aforementioned range, it may be said that the lubricating oil composition is good in various properties, such as a viscosity in a high-temperature region assuming the time of high-speed operation of an engine.

In the present specification, the HTHS viscosity at 150° C. is a value of a high temperature high shear viscosity at 150° C. as measured in conformity with ASTM D4683 (JPI-5S-36-03).

The lubricating oil composition of the present embodiment is used as a lubricating oil composition for engine equipped with a forced-induction mechanism, and in particular, it is suitably used as a lubricating oil composition for engine equipped with a direct-injection forced-induction mechanism. Examples of the forced-induction mechanism include a supercharger and a turbocharger.

<Method for Suppressing Low-Speed Pre-Ignition in an Engine Equipped with a Forced-Induction Mechanism>

A method for suppressing low-speed pre-ignition in an engine equipped with a forced-induction mechanism according to the present embodiment includes adding the aforementioned lubricating oil composition for engine equipped with a forced-induction mechanism according to the present embodiment to an engine equipped with a forced-induction mechanism.

In accordance with the method for suppressing low-speed pre-ignition in an engine equipped with a forced-induction mechanism according to the present embodiment, the frequency of occurrence of abnormal combustion, such as LSPI, can be lowered.

<Method for Producing a Lubricating Oil Composition for Engine Equipped with a Forced-Induction Mechanism>

A method for producing a lubricating oil composition for engine equipped with a forced-induction mechanism according to the present embodiment includes a mixing step of mixing a base oil (A), a metal-containing surfactant (B) containing at least a calcium-containing surfactant (b1), and at least one basic compound (C) selected from a metal carbonate, a metal hydrogencarbonate, a metal hydroxide, and an amine-based compound, wherein the mixing step is performed so as to satisfy the following mixing conditions (1) to (3):

<Mixing Conditions>

(1) The sulfur content contained in the metal-containing surfactant (B) is 0.2 mass % or more on the basis of the whole amount of the metal-containing surfactant (B);

(2) The content of a calcium atom is 0.08 to 0.20 mass % on the basis of the whole amount of the composition; and (3) A mass ratio of the content of the basic compound (C) and the content of a calcium atom derived from the calcium-containing surfactant (b1) [(content of (C))/(calcium content derived from (b1))] is 2.0 or more.

In the aforementioned mixing step, the metal-containing surfactant (B) and the basic compound (C) may be mixed, followed by adding the mixture to the base oil (A), or the metal-containing surfactant (B) and the basic compound (C) may be separately added to the base oil (A).

In the method for producing a lubricating oil composition for engine equipped with a forced-induction mechanism according to the present embodiment, furthermore, it is preferred to perform the aforementioned step so as to satisfy a preferred embodiment of the lubricating oil composition for engine equipped with a forced-induction mechanism according to the present embodiment.

For example, it is preferred to perform the aforementioned step such that the sulfur content contained in the metal-containing surfactant (B) is 0.3 mass % or more on the basis of the whole amount of the metal-containing surfactant (B). In addition, it is preferred to perform the aforementioned step such that the sulfur content contained in the calcium-containing surfactant (b1) is 0.3 mass % or more on the basis of the whole amount of the calcium-containing surfactant (b1).

In accordance with the method for producing a lubricating oil composition for engine equipped with a forced-induction mechanism according to the present embodiment, it is possible to simply produce a lubricating oil composition capable of lowering the frequency of occurrence of abnormal combustion, such as LSPI.

EXAMPLES

Next, the present embodiment is more specifically described by reference to Examples.

1. Evaluation 1-1. Confirmation of Abnormal Combustion

With respect to sample oils of Test Examples 1 to 6 as prepared in compositions shown in Table 1, the occurrence of abnormal combustion was confirmed by the following methods.

<Specification and Operation Conditions of Internal Combustion Engine for Test (Spark-Ignition Internal Combustion Engine)>

(1) Bore diameter: 85 mm (2) Stroke length: 70 mm (3) Displacement: 397 $cm^3$ (4) Compression ratio: 8/1

(5) Engine speed: 1,400 rpm (6) Air-fuel ratio: Theoretical air-fuel ratio (7) Ignition timing: −5° aTDC <Explanation of Evaluation Methods>

In the aforementioned engine, a small-sized quartz window was provided in a cylinder head, and a light from a xenon light source was transmitted through a right end portion of a combustion chamber, thereby carrying out light absorption measurement in the end portion. The xenon light having been transmitted through the combustion chamber was introduced into a spectroscope by optical fibers and spectrally separated in a wavelength of 293.1 nm. This wavelength is a wavelength at which strong absorption occurs in formaldehyde. The formaldehyde is an important chemical species such that it is produced at the time of generation of a cool flame (at the time of low-temperature oxidation reaction) and abruptly reduced with the movement into a blue flame and the generation of a hot flame. The spectrally separated light was converted into an electric signal by a photomultiplier tube, and by using a transmission light intensity E0 in a state where no reaction took place and a transmission light intensity E1 at an arbitrary crank angle, an absorbance was defined as (E0−E1)/E0 and calculated. A timing at which an increase of this absorbance started was defined as a generation timing of a cool flame, and a timing at which the absorbance abruptly decreased was defined as an autoignition timing. In addition, a pressure sensor was provided within the combustion chamber, and an amplitude of pressure vibration generated at the time of knocking was measured and defined as an index of the knock intensity.

In an internal combustion engine provided with a reciprocating piston, a mixed gas composed of a fuel and an oxidizing agent is compressed by the piston in a cylinder interior, whereby the temperature and pressure increase. At this time, before original ignition accompanied by definite heat generation is generated, the mixed gas ignites itself due to the compression to cause combustion, namely low-temperature autoignition occurs. This low-temperature autoignition includes a stage at which a low-temperature flame called a cool flame or a blue flame reveals, and an active chemical species is produced, leading to generation and propagation of a hot flame accompanied by abrupt heat generation.

In the aforementioned internal combustion engine for test, an active chemical species is forcedly provided by an ignition source, such as an electric spark, leading to generation and propagation of a hot flame. For this reason, in the case where the progress of a low-temperature autoignition reaction is faster than the generation and propagation of a hot flame originated from the ignition, a deterioration of the combustion state or abrupt pressure vibration is generated. The generation of this abrupt pressure vibration causes knocking. Therefore, as mentioned above, the amplitude of the pressure vibration caused at the time of knocking was measured and defined as an index of the knock intensity.

After the aforementioned engine was subjected to a warming up operation to set a spark plug washer temperature to 450 to 470K, each of the sample oils of Test Examples 1 to 6 as prepared in the compositions shown in Table 1 was forcedly introduced into the combustion chamber through a fuel injector, and a fuel oil was replaced in the sample oil and combusted. Since a general-purpose lubricant base oil is high in viscosity as compared with the fuel oil, it is difficult to spray a lubricating oil composition containing the general-purpose lubricant base oil by a fuel injector. For this reason, by using a fuel oil (PRF50) composed of a mixture of n-heptane and isooctane in a mass ratio of 50/50 in place of the lubricant base oil, PRF50 was mixed with the metal-containing surfactant (B) containing at least the calcium-containing surfactant (b1) and the basic compound (C), thereby obtaining the sample oils of Test Examples 1 to 6.

An amount of the lubricating oil composition which invades into the combustion chamber from the crank chamber due to the oil loss is not constant but is largely dominated by the probability. On the occasion when a large amount of the lubricating oil composition accidentally invades into the combustion chamber, and droplets of the lubricating oil composition itself are scattered into the interior of the combustion chamber, the influence which the lubricating oil composition gives to the combustion becomes maximum.

The droplets which have invaded into the combustion chamber may be one resulting from dilution of an engine oil with a directly injected fuel, namely a mixture of an engine oil having high ignitionability with a gasoline having low ignitionability. For that reason, the maximum influence to which the composition may give can be evaluated by forcedly scatting the droplets having specified properties into the interior of the combustion chamber and analyzing the combustion state.

Then, in the present combustibility test, on assuming the case where in a spark ignition engine, especially an engine equipped with a direction-injection supercharger, a large amount of the lubricating oil composition accidentally invades into the combustion chamber, the sample oil was forcedly introduced into the combustion chamber, as mentioned above.

It is to be noted that in the spark ignition engine used for the combustibility test, a general lubricating oil composition is filled in the crank chamber and the like; however, since the invasion of the lubricating oil composition from the crank chamber into the combustion chamber is restricted, it is not necessary to consider the influence against the results of the present test.

In view of the fact that both the lubricant base oil and the fuel oil are a hydrocarbon, it may be considered that a difference in reactivity with the additive is small and that the influence which droplets of a fuel oil containing a certain concentration of an organic metal-based additive give to the combustion is close to that in the case where droplets of a lubricant base oil containing the foregoing additive are scattered within the combustion chamber. For that reason, as a result of the test, so long as the fuel oil containing a predetermined additive does not influence the combustion, even in the case where the lubricating oil composition similarly containing the foregoing predetermined additive invaded into the combustion chamber, it can be judged that the combustion is not influenced. Conversely, so long as the combustion is influenced, when the lubricating oil composition invades into the combustion chamber in the actual equipment, it can be judged that there is a possibility that the combustion is influenced.

The overall evaluation was made according to the following criteria. In the case where the evaluation is A, the generation timing of a cool flame is equal or close to the timing of usual spark discharge, and the value of pressure vibration is low, and hence, it may be said that the deterioration of the combustion state was inhibited, and the knocking was inhibited. On the other hand, in the case where the evaluation is B, though the value of the pressure vibration is low, the generation timing of a flame is faster than the timing of usual spark discharge, and hence, it may be said that the combustion state was deteriorated, and the knocking was promoted. In the case where the evaluation is C, the generation timing of a flame is faster than the timing of usual spark discharge, and the value of pressure vibration is high, and hence, it may be said that the degree of deterioration of the combustion state was high, and the knocking was more promoted.

<Criteria of Overall Evaluation>

A: The value of pressure vibration is not more than a value of a standard sample oil (sample oil of Test Example 1), and the generation timing of a cool flame is not accelerated as compared with the standard sample oil.

B: Although the value of pressure vibration is not more than a value of a standard sample oil (sample oil of Test Example 1), the generation timing of a cool flame is accelerated as compared with the standard sample oil.

C: The value of pressure vibration is more than a value of a standard sample oil (sample oil of Test Example 1), and the generation timing of a cool flame is accelerated as compared with the standard sample oil.

From the measurement results of Test Examples 2 and 4, in the case where the [(content of (C))/(calcium content derived from (b1))] is equivalent, it can be confirmed that in Test Example 4 in which the content of sulfur contained in the metal-containing surfactant (b1) (in the case of Test Examples 2 and 4, the sulfur content of (b1) is equal to the sulfur content of (B)) is larger, the value of pressure vibration is lower.

In addition, it can be understood that in Test Example 6 in which the calcium alkylphenate having the content of sulfur of 8.0 mass % or more is contained, and the [(content of (C))/(calcium content derived from (b1))] is 5.0 or more, the value of pressure vibration can be largely suppressed.

TABLE 1

| | | | | Test Example | | | | | |
|---|---|---|---|---|---|---|---|---|---|
| | | | | 1 | 2 | 3 | 4 | 5 | 6 |
| Fuel oil | | PRF50 | — | 100.00 | Balance | Balance | Balance | Balance | Balance |
| Metal-containing surfactant (B) | Calcium-containing surfactant (b1) | Calcium alkylsalicylate A | mass % | — | 0.45 | — | — | — | — |
| | | Calcium alkylsalicylate B | mass % | — | — | 2.60 | — | — | — |
| | | Calcium alkylbenzenesulfonate A | mass % | — | — | — | 0.48 | — | — |
| | | Calcium alkylbenzenesulfonate B | mass % | — | — | — | — | 4.85 | — |
| | | Calcium alkylphenate A | mass % | — | — | — | — | — | 0.82 |
| Basic compound (C) | | Calcium carbonate | mass % | — | 0.46 | 0.21 | 0.46 | — | 0.37 |
| | | Calcium hydroxide | mass % | — | — | — | — | 0.11 | — |
| Characteristic values | | Sulfur content of (B) | mass % | — | 0.4 | 0.7 | 5.6 | 5.2 | 8.1 |
| | | Calcium content in sample oil | mass % | — | 0.20 | 0.20 | 0.20 | 0.20 | 0.20 |
| | | Calcium content derived from (b1) | mass % | — | 0.018 | 0.117 | 0.016 | 0.146 | 0.05 |
| | | (Content of (C))/(calcium content derived from (b1)) | — | — | 25.6 | 1.8 | 28.8 | 0.8 | 7.4 |
| Measurement results | | Pressure vibration (MPa) | | 0.077 | 0.066 | 0.156 | 0.029 | 0.056 | 0.019 |
| | | Acceleration of generation timing of cool flame | | Standard | No | Yes | No | Yes | No |
| | | Overall results | | — | A | C | A | B | A |

In Table 1, the materials and the like used are as follows.

PRF50: Fuel oil composed of a mixture of n-heptane and isooctane in a mass ratio of 50/50

Calcium alkylsalicylate A: Calcium alkylsalicylate A having a sulfur content of 0.4 mass % and a calcium content of 3.9%

Calcium alkylsalicylate B: Calcium alkylsalicylate having a sulfur content of 0.7 mass % and a calcium content of 4.5%

Calcium alkylbenzenesulfonate A: Calcium alkylbenzenesulfonate having a sulfur content of 5.6 mass % and a calcium content of 3.4%

Calcium alkylbenzenesulfonate B: Calcium alkylbenzenesulfonate having a sulfur content of 5.2 mass % and a calcium content of 3.0%

Calcium alkylphenate A: Calcium alkylphenate having a sulfur content of 8.1 mass % and a calcium content of 6.1%

The lubricating oil compositions of Test Examples 2, 4, and 6 are ones satisfying the conditions of the lubricating oil composition for engine equipped with a forced-induction mechanism according to the present embodiment except for the base oil (a). From the results of Table 1, it can be confirmed that in the lubricating oil compositions of Test Examples 2, 4, and 6, no abnormal combustion is generated.

From comparison between Test Example 2 and Test Example 3 as well as comparison between Test Example 4 and Test Example 5, it can be understood that as the value of [(content of (C))/(calcium content derived from (b1))] is higher, the value of pressure vibration is lower, and the generation timing of a cool flame is more hardly accelerated.

1-2. LSPI Preventing Performance of Lubricating Oil Composition

With respect to the lubricating oil compositions of the Examples and Comparative Examples prepared in compositions shown in Table 2, a peak value of heat flow was measured based on the following method, and the LSPI preventing performance based on the peak value of heat flow was evaluated. The results are shown in Table 2.

(Measurement of Peak Value of Heat Flow)

With respect to the prepared lubricating oil compositions, the generation of heat flow following a temperature rise was analyzed using a high-pressure differential scanning calorimeter. A material in which 5 mg of a test oil was dropped in an aluminum pan was used as a measurement sample, and an aluminum pan in which a test oil was not dropped was used as a standard. An air pressure was set to 10 atm, and the measurement was performed in an air atmosphere. The temperature rise was performed to 400° C. at a rate of 10° C./min. In general, when the temperature is raised, a lubricating oil composition causes the momentary heat generation at a specified temperature and burns. As the peak value of the amount of heat generation on the occasion of causing the momentary heat generation at that time is larger, a combustion reaction is liable to be caused within a combustion chamber, namely LSPI is liable to be induced. Then, a peak value of the heat flow corresponding to a heat generation rate was determined on the basis of the amount of heat generation on the occasion of causing the momentary heat generation, thereby determining a value per the sample amount (mg). It may be said that as the peak value is smaller, the LSPI preventing performance is more favorable. Values of 68.0 mW/mg or less are evaluated to be acceptable.

TABLE 2

| | | | Example | | | | | |
|---|---|---|---|---|---|---|---|---|
| | | | 1 | 2 | 3 | 4 | 5 | 6 |
| Base oil (A) | Hydrorefined base oil | — | Balance | Balance | Balance | Balance | Balance | Balance |
| Metal-containing surfactant (B) (b1) | Calcium alkylsalicylate A | mass % | 0.34 | — | — | — | — | — |
| | Calcium alkylsalicylate B | mass % | — | — | — | 1.95 | 1.95 | 1.95 |
| | Calcium alkylbenzenesulfonate A | mass % | — | 0.36 | — | — | — | — |
| | Calcium alkylbenzenesulfonate B | mass % | — | — | — | — | — | — |
| | Calcium alkylphenate A | mass % | — | — | 0.58 | — | — | — |
| (b2) | Magnesium alkylbenzenesulfonate A | mass % | — | — | — | — | — | — |
| (b3) | Sodium alkylbenzenesulfonate A | mass % | — | — | — | — | — | — |
| Basic compound (C) | Calcium carbonate | mass % | 0.34 | 0.34 | 0.27 | 0.16 | 0.16 | 0.16 |
| | Calcium hydroxide | mass % | — | — | — | — | — | — |
| | Amine-based compound A | mass % | — | — | — | 0.20 | 0.50 | — |
| | Amine-based compound B | mass % | — | — | — | — | — | 0.50 |
| | Magnesium carbonate | mass % | — | — | — | — | — | — |
| | Sodium carbonate | mass % | — | — | — | — | — | — |
| Arbitrary additives | Viscosity index improver | mass % | Adjusted | Adjusted | Adjusted | Adjusted | Adjusted | Adjusted |
| | Other additives | mass % | 8.3 | 8.3 | 8.3 | 8.3 | 8.3 | 8.3 |
| Characteristic values | Kinematic viscosity at 40° C. | $mm^2/s$ | 28.7 | 28.4 | 29.0 | 32.4 | 32.5 | 30.9 |
| | Kinematic viscosity at 100° C. | $mm^2/s$ | 6.2 | 6.1 | 6.2 | 6.5 | 6.5 | 6.3 |
| | Viscosity index | — | 174 | 173 | 173 | 157 | 157 | 161 |
| | HTHS viscosity at 150° C. | mPa · s | 2.3 | 2.3 | 2.3 | 2.3 | 2.3 | 2.3 |
| | Calcium content of the whole amount of composition | mass % | 0.15 | 0.15 | 0.15 | 0.15 | 0.15 | 0.15 |
| | Sulfur content of the whole amount of composition | mass % | 0.22 | 0.23 | 0.25 | 0.31 | 0.4 | 0.22 |
| | Magnesium content of the whole amount of composition | mass % | <0.001 | <0.001 | <0.001 | <0.001 | <0.001 | <0.001 |
| | Sodium content of the whole amount of composition | mass % | <0.001 | <0.001 | <0.001 | <0.001 | <0.001 | <0.001 |
| | Molybdenum content of the whole amount of composition | mass % | 0.07 | 0.07 | 0.07 | 0.07 | 0.07 | 0.07 |
| | Phosphorus content of the whole amount of composition | mass % | 0.08 | 0.08 | 0.08 | 0.08 | 0.08 | 0.08 |
| | Zinc content of the whole amount of composition | mass % | 0.09 | 0.09 | 0.09 | 0.09 | 0.09 | 0.09 |
| | Sulfur content of (B) | mass % | 0.4 | 5.6 | 8.1 | 0.7 | 0.7 | 0.7 |
| | Calcium content derived from (b1) | mass % | 0.013 | 0.012 | 0.043 | 0.088 | 0.088 | 0.088 |
| | (Content of (C))/(calcium content derived from (b1)) | — | 26.2 | 28.3 | 6.3 | 4.1 | 7.5 | 7.5 |
| | (Content of (B))/(content of (C)) | — | 1.0 | 1.1 | 2.1 | 5.4 | 3.0 | 3.0 |
| | (Calcium content derived from (b1))/(calcium content of the whole amount of composition | — | 0.09 | 0.08 | 0.29 | 0.59 | 0.59 | 0.59 |
| Evaluation | Heat flow peak value | mW/mg | 67.3 | 67.7 | 65 | 64.7 | 31.1 | 65.2 |

| | | | Example | | Comparative Example | | |
|---|---|---|---|---|---|---|---|
| | | | 7 | 8 | 1 | 2 | 3 |
| Base oil (A) | Hydrorefined base oil | — | Balance | Balance | Balance | Balance | Balance |
| Metal-containing surfactant (B) (b1) | Calcium alkylsalicylate A | mass % | — | — | — | — | — |
| | Calcium alkylsalicylate B | mass % | 1.95 | — | 1.95 | — | — |
| | Calcium alkylbenzenesulfonate A | mass % | — | — | — | — | — |
| | Calcium alkylbenzenesulfonate B | mass % | — | 3.62 | — | 3.62 | — |
| | Calcium alkylphenate A | mass % | — | — | — | — | 0.82 |
| (b2) | Magnesium alkylbenzenesulfonate A | mass % | — | 0.19 | — | — | — |
| (b3) | Sodium alkylbenzenesulfonate A | mass % | 0.08 | — | — | — | — |
| Basic compound (C) | Calcium carbonate | mass % | 0.16 | — | 0.16 | — | 0.37 |
| | Calcium hydroxide | mass % | — | 0.08 | — | 0.08 | — |
| | Amine-based compound A | mass % | — | — | — | — | — |
| | Amine-based compound B | mass % | — | — | — | — | — |
| | Magnesium carbonate | mass % | — | 0.20 | — | — | — |
| | Sodium carbonate | mass % | 0.15 | — | — | — | — |
| Arbitrary additives | Viscosity index improver | mass % | Adjusted | Adjusted | Adjusted | Ad-justed | Adjusted |
| | Other additives | mass % | 8.3 | 8.3 | 8.3 | 8.3 | 8.3 |
| Characteristic values | Kinematic viscosity at 40° C. | $mm^2/s$ | 32.2 | 32.7 | 32.1 | 32.4 | 29.5 |
| | Kinematic viscosity at 100° C. | $mm^2/s$ | 6.5 | 6.6 | 6.5 | 6.5 | 6.3 |
| | Viscosity index | — | 163 | 162 | 159 | 160 | 174 |
| | HTHS viscosity at 150° C. | mPa · s | 2.3 | 2.3 | 2.3 | 2.3 | 2.3 |
| | Calcium content of the whole amount of composition | mass % | 0.15 | 0.15 | 0.15 | 0.15 | 0.21 |
| | Sulfur content of the whole amount of composition | mass % | 0.23 | 0.44 | 0.22 | 0.44 | 0.27 |
| | Magnesium content of the whole amount of composition | mass % | <0.001 | 0.06 | <0.001 | <0.001 | <0.001 |
| | Sodium content of the whole amount of composition | mass % | 0.09 | <0.001 | <0.001 | <0.001 | <0.001 |

TABLE 2-continued

| | | | | | | | |
|---|---|---|---|---|---|---|---|
| | Molybdenum content of the whole amount of composition | mass % | 0.07 | 0.07 | 0.07 | 0.07 | 0.07 |
| | Phosphorus content of the whole amount of composition | mass % | 0.08 | 0.08 | 0.08 | 0.08 | 0.08 |
| | Zinc content of the whole amount of composition | mass % | 0.09 | 0.09 | 0.09 | 0.09 | 0.09 |
| | Sulfur content of (B) | mass % | 0.84 | 5.2 | 0.7 | 5.2 | 8.1 |
| | Calcium content derived from (b1) | mass % | 0.088 | 0.108 | 0.088 | 0.108 | 0.050 |
| | (Content of (C))/(calcium content derived from (b1)) | — | 3.5 | 2.6 | 1.8 | 0.7 | 7.4 |
| | (Content of (B))/(content of (C)) | — | 6.5 | 13.6 | 12.2 | 45.3 | 2.2 |
| | (Calcium content derived from (b1))/(calcium content of the whole amount of composition | — | 0.59 | 0.72 | 0.59 | 0.72 | 0.24 |
| Evaluation | Heat flow peak value | mW/mg | 41 | 66.7 | 68.7 | 71.7 | 70.7 |

In Table 2, the materials and the like used are as follows.

<Base Oil (A)>

Hydrorefined base oil (kinematic viscosity at 40° C.; 21 $mm^2/s$, kinematic viscosity at 100° C.; 4.5 $mm^2/s$, viscosity index; 135, sulfur content; less than 20 ppm by mass, NOACK value; 12.6 mass %, n-d-M ring analysis; % $C_A$; 0.0, % $C_p$; 78.7)

<Metal-Containing Surfactant (B)>

[Calcium-Containing Surfactant (b1)]

The calcium alkylsalicylate A, the calcium alkyl salicylate B, the calcium alkylbenzenesulfonate A, the calcium alkylbenzenesulfonate B, and the calcium alkylphenate A are the same as those in Table 1.

[Magnesium-Containing Surfactant (b2)]

Magnesium alkylbenzenesulfonate A: Magnesium alkylbenzenesulfonate having a sulfur content of 6.0 mass % and a magnesium content of 1.3 mass %

[Sodium-Containing Surfactant (b3)]

Sodium alkylbenzenesulfonate A: Sodium alkylbenzenesulfonate having a sulfur content of 4.2 mass % and a sodium content of 34.7 mas %

<Basic Compound (C)>

Calcium carbonate

Calcium hydroxide

Amine-based compound A: Metal-free dithiocarbamate (bis(dibutyldithiocarbamate)methylene)

Magnesium carbonate

Sodium carbonate

Amine-based compound B: Aliphatic amine-based compound (oleyl diethanolamine)

<Additives>

Viscosity index improver; Polymethacrylate (PMA, Mw=510,000, resin component concentration: 19 mass %)

Other additives; Molybdenum dithiocarbamate (molybdenum content: 10 mass %), macromolecular alkenyl succinimide (base number; 24 mgKOH/g, nitrogen content: 1 mass %), boronated alkenyl succinimide (base number: 25 mgKOH/g, nitrogen content: 1.2 mass %, boron content: 1.3 mass %), zinc dithiophosphate (zinc content: 8.9 mass %, phosphorus content: 7.4 mass %, sulfur content: 15.0 mass %), diphenylamine, alkylphenol, copper deactivator, silicone-based anti-foaming agent, and polymethacrylate-based pour-point depressant From the results of Table 2, it can be confirmed that the lubricating oil compositions for engine equipped with a forced-induction mechanism of Examples 1 to 8 are low in the peak value of heat flow and excellent in the LSPI preventing performance.

In Comparative Examples 1 and 2, the [(content of (C))/(calcium content derived from (b1))] is less than 2.0, and therefore, the peak value of heat flow becomes high.

In addition, in Comparative Example 3, it can be confirmed that the content of a calcium atom is more than 0.20 mass % on the basis of the whole amount of the composition, and therefore, the peak value of heat flow becomes high.

The invention claimed is:

1. A lubricating oil composition for engine equipped with a forced-induction mechanism, the composition comprising:

a base oil (A), a metal-containing surfactant (B) containing at least a calcium-containing surfactant (b1), and at least one basic compound (C) selected from the group consisting of a metal carbonate, a metal hydrogencarbonate, a metal hydroxide, and an amine-based compound, wherein the content of sulfur contained in the metal-containing surfactant (B) is 0.2 mass % or more on the basis of the whole amount of the metal-containing surfactant (B);

the content of a calcium atom is from 0.08 to 0.20 mass % on the basis of the whole amount of the composition; and a mass ratio of the content of the basic compound (C) and the content of a calcium atom derived from the calcium-containing surfactant (b1) [(content of (C))/(calcium content derived from (b1))] is 2.0 or more;

wherein the amine-based compound included for selection as the at least one basic compound (C) is selected from the group consisting of ammonia, a metal-free dithiocarbamate and an aliphatic amine-based compound selected from the group consisting of an amine compound (c1) having one or more hydroxy groups and one or more amino groups represented by the following general formulae (C1) ,(C2), (C3) and (C4); an amine compound (c2) having two or more amino groups represented by the general formula (C3) or (C4); and an amine compound (c3) having only one amino group represented by the general formula (C5), (C1)

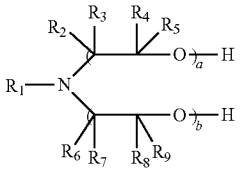

-continued (C2)

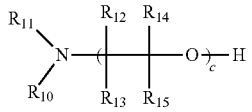

(C3)

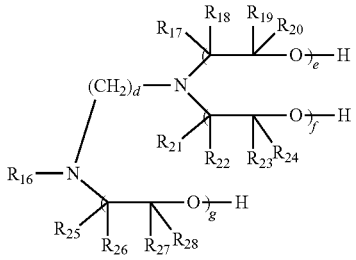

(C4)

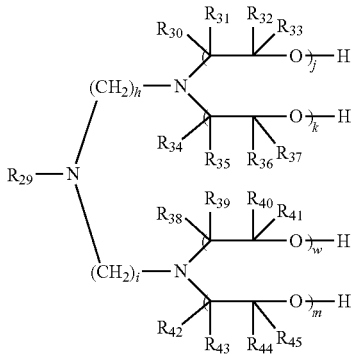

(C5)

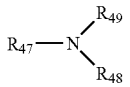

wherein $R_1$, $R_{10}$, $R_{11}$, $R_{16}$, $R_{29}$, and $R_{47}$ are each a hydrocarbon group having a carbon number of 1 to 32, and $R_{10}$ and $R_{11}$ may be the same as or different from each other, such hydrocarbon group being saturated or unsaturated, aliphatic or aromatic, and straight-chained, branched, or cyclic, $R_2$ to $R_9$, $R_{12}$ to $R_{15}$, $R_{17}$ to $R_{28}$, $R_{30}$ to $R_{45}$, and $R_{48}$ to $R_{49}$ are each independently a hydrogen atom, a hydrocarbon group having a carbon number of 1 to 18, or an oxygen-containing hydrocarbon group containing an ether bond or an ester bond, the hydrocarbon group being saturated or unsaturated, aliphatic or aromatic, and being straight-chained, branched, or cyclic, a, b, c, e, f, g, j, k, w, and m each represent an integer of 0 to 20, d, h, and i each represent an integer of 1 to 6, (a+b) is 1 to 20, (e+f+g) is 0 to 20, and (j+k+w+m) is 0 to 20.

2. The lubricating oil composition for engine equipped with a forced-induction mechanism according to claim 1, wherein the sulfur content contained in the calcium-containing surfactant (b1) is 0.3 mass % or more on the basis of the whole amount of the calcium-containing surfactant (b1).

3. The lubricating oil composition for engine equipped with a forced-induction mechanism according to claim 1, wherein the metal-containing surfactant (B) further contains at least one selected from the group consisting of a magnesium-containing surfactant (b2) and a sodium-containing surfactant (b3).

4. The lubricating oil composition for engine equipped with a forced-induction mechanism according to claim 1, wherein the content of the basic compound (C) is from 0.10 to 1.00 mass % on the basis of the whole amount of the composition.

5. The lubricating oil composition for engine equipped with a forced-induction mechanism according to claim 1, wherein the basic compound (C) contains at least one selected from the group consisting of lithium carbonate, sodium carbonate, potassium carbonate, magnesium carbonate, calcium carbonate, barium carbonate, lithium hydroxide, sodium hydroxide, potassium hydroxide, magnesium hydroxide, calcium hydroxide, and barium hydroxide.

6. The lubricating oil composition for engine equipped with a forced-induction mechanism according to claim 1, wherein the sulfur content is from 0.01 to 0.80 mass % on the basis of the whole amount of the composition.

7. The lubricating oil composition for engine equipped with a forced-induction mechanism according to claim 1, wherein the calcium-containing surfactant (b1) is at least one of calcium phenate and calcium sulfonate.

8. A method for suppressing low-speed pre-ignition in an engine equipped with a forced-induction mechanism, the method comprising adding the lubricating oil composition for engine equipped with a forced-induction mechanism according to claim 1 to an engine equipped with a forced-induction mechanism.

9. A method for producing a lubricating oil composition for engine equipped with a forced-induction mechanism, the method comprising a mixing step of mixing a base oil (A), a metal-containing surfactant (B) containing at least a calcium-containing surfactant (b1), and at least one basic compound (C) selected from the group consisting of a metal carbonate, a metal hydrogencarbonate, a metal hydroxide, and an amine-based compound, wherein the mixing step is performed so as to satisfy the following mixing conditions (1) to (3):

<Mixing conditions>

(1) The sulfur content contained in the metal-containing surfactant (B) is 0.2 mass % or more on the basis of the whole amount of the metal-containing surfactant (B);

(2) The content of a calcium atom is from 0.08 to 0.20 mass % on the basis of the whole amount of the composition; and (3) A mass ratio of the content of the basic compound (C) and the content of a calcium atom derived from the calcium-containing surfactant (b1) [(content of (C))/(calcium content derived from (b1))] is 2.0 or more;

wherein the amine-based compound included for selection as the at least one basic compound (C) is selected from the group consisting of ammonia, a metal-free dithiocarbamate and an aliphatic amine-based compound selected from the group consisting of an amine compound (c1) having one or more hydroxy groups and one or more amino groups represented by the following general formulae (C1), (C2), (C3) and (C4); an amine compound (c2) having two or more amino groups represented by the general formula (C3) or (C4); and an amine compound (c3) having only one amino group represented by the general formula (C5), (C1)

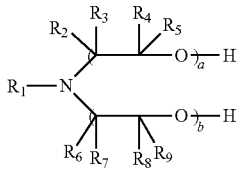

(C2)

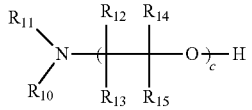

(C3)

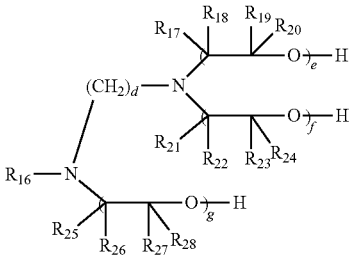

-continued (C4)

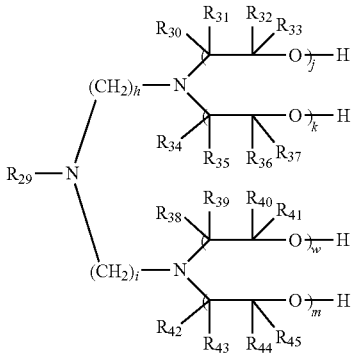

(C5)

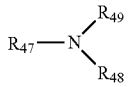

wherein $R_1$, $R_{10}$, $R_{11}$, $R_{16}$, $R_{29}$, and $R_{47}$ are each a hydrocarbon group having a carbon number of 1 to 32, and $R_{10}$ and $R_{11}$ may be the same as or different from each other, such hydrocarbon group being saturated or unsaturated, aliphatic or aromatic, and straight-chained, branched, or cyclic, $R_2$ to $R_9$, $R_{12}$ to $R_{15}$, $R_{17}$ to $R_{28}$, $R_{30}$ to $R_{45}$, and $R_{48}$ to $R_{49}$ are each independently a hydrogen atom, a hydrocarbon group having a carbon number of 1 to 18, or an oxygen-containing hydrocarbon group containing an ether bond or an ester bond, the hydrocarbon group being saturated or unsaturated, aliphatic or aromatic, and being straight-chained, branched, or cyclic, a, b, c, e, f, g, j, k, w, and m each represent an integer of 0 to 20, d, h, and i each represent an integer of 1 to 6, (a+b) is 1 to 20, (e+f+g) is 0 to 20, and (j+k+w+m) is 0 to 20.

* * * * *